United States Patent [19]

Birch et al.

[11] Patent Number: 5,030,122

[45] Date of Patent: Jul. 9, 1991

[54] SELF TERMINATING CONNECTOR AND CABLE ASSEMBLY

[75] Inventors: Norman R. Birch, Jacobus; James G. Dunbar, Lancaster; Harold W. Kerlin, Port Royal; Wilmer L. Sheesley, Dauphin; Edward C. Vees, Camp Hill, all of Pa.

[73] Assignee: AMP Incorporated, Harrisburg, Pa.

[21] Appl. No.: 519,968

[22] Filed: May 7, 1990

Related U.S. Application Data

[63] Continuation-in-part of Ser. No. 354,070, May 19, 1989, abandoned, and a continuation-in-part of Ser. No. 340,979, Apr. 20, 1989, abandoned.

[51] Int. Cl.[5] ..... H01R 17/04; H01R 33/96

[52] U.S. Cl. ..... 439/188; 200/51.1; 439/579

[58] Field of Search ..... 439/578–585, 439/188, 620; 333/22 R; 200/51.09, 51.1; 338/220

[56] References Cited

U.S. PATENT DOCUMENTS

| | | | |
|---|---|---|---|
| 2,640,118 | 5/1953 | Werner | 200/51.1 |
| 4,575,694 | 3/1986 | Lapke et al. | 333/22 R |
| 4,588,249 | 5/1986 | Blichasz et al. | 439/483 |
| 4,660,921 | 4/1987 | Hauver | 439/578 |
| 4,666,231 | 5/1987 | Sheesley et al. | 439/488 |
| 4,687,446 | 8/1987 | Birch et al. | 439/553 |
| 4,773,879 | 9/1988 | Pauza | 439/579 |
| 4,804,339 | 2/1989 | Cohen | 439/588 |
| 4,971,569 | 11/1990 | Gooch et al. | 439/188 |

OTHER PUBLICATIONS

AMP Network/Premises Interconnection Products for Voice, Data, Power Catalog, 86–780; 9/86.

*Primary Examiner*—Neil Abrams
*Attorney, Agent, or Firm*—Gerald K. Kita

[57] ABSTRACT

Ends of electrical conductors 5 of an electrical cable are joined to corresponding self terminating, shielded connectors 4, each comprising, a conductive shell 20 connected to at least one corresponding sheath 8, a dielectric support 29 in the shell 20, a conductive switch contact 23 connected to a corresponding signal transmitting conductor 5 and carried by the dielectric support 29 for disconnect connection to an electrical contact inserted into the shielded connector 4, and an electrical circuit element 24 in contact with the shell 20 constructed for disconnect coupling with the switch contact 23 upon withdrawal of the electrical contact from the shielded connector 4, whereby the switch contact 23 is terminated electrically to the shell 20 through the circuit element 24.

18 Claims, 5 Drawing Sheets

SELF TERMINATING CONNECTOR AND CABLE ASSEMBLY

This is a continuation in part of application Ser. No. 354,070 filed May 19, 1989 and a continuation in part of application Ser. No. 340,979 filed Apr. 20, 1989, both abandoned.

FIELD OF THE INVENTION

An electrical connector is disclosed for connection to an electrical cable having multiple signal carrying conductors to provide a connector, and particularly a connector incorporating an electrical circuit element.

BACKGROUND OF THE INVENTION

An electrical cable comprised of multiple signal carrying conductors is utilized as a shielded bus of a local area network to interconnect a host computer and work stations that communicate with one another through the network.

The host computer or any one of the workstations provides a packet of electronic data to be sent over the bus. Each work station is associated with an electronic transceiver that functions to transmit the packet to the bus, or to detect a collision of the packet with another packet being transmitted along the bus. Upon detection of a collision, the transceiver sends an electronic collision signal back to the work station, causing the work station to delay transmission of the packet. The process is repeated until the transceiver functions to transmit the packet to the bus. Each transceiver is distinguished from other transceivers by an electronic address. Each packet is encoded with an address to insure that a selected transceiver receives the packet and transmits the packet to the work station associated with that transceiver. Each work station gains access to the network through the transceiver and a cable assembly having a shielded electrical connector that connects to the bus.

A known cable assembly is disclosed in U.S. Pat. No. 4,773,879 comprising, an electrical cable having multiple signal carrying conductors encircled by dielectric material and by at least one conductive sheath, and ends of the cable joined to corresponding electrical connectors. The cable includes two coaxial cables, and conductive sheaths of both cables are connected to a conductive shell of a connector, and two signal transmitting conductors of the two cables are connected to a center contact of the connector that is ordinarily suited for connection to a single coaxial cable. This cable assembly is suitable as a drop wire for disconnect connection of a single work station to a transceiver permanently installed along a bus of a local area network. The transceiver functions to prevent disruption of the bus when the work station and the drop wire are disconnected from the bus. A need exists for a cable assembly that interconnects work stations that incorporate their own transceivers. A further need exists for a cable assembly that will serve as a bus for interconnecting such work stations. A further need exits for a cable assembly that will self terminate to prevent disruption of the bus when such a work station is disconnected from the bus. A further need exists for a cable assembly that link together with similar cable assemblies to form a bus that will self terminate to remain operative in the absence of a work station connected to a connector of the cable assemblies.

SUMMARY OF THE INVENTION

An objective of the invention is to provide a shielded electrical connector and a cable assembly, which are useful for connecting a work station to a bus of a local area network. An advantage of the invention resides in a cable assembly and a connector that is self terminating when an electrical contact of a work station, especially a work station incorporating a transceiver, is disconnected from the bus, leaving the bus operative in the absence of the work station. A feature of the invention resides in an electrical circuit element in contact with a conductive shell of the connector constructed for disconnect coupling upon withdrawal of an electrical contact from the connector, whereby the switch contact is terminated to the shell through the circuit element.

Accordingly, a cable assembly comprises, an electrical cable having multiple signal carrying conductors encircled by dielectric material and by at least one conductive sheath, and ends of the cable joined to corresponding electrical connectors, corresponding first ends of the cable joined to corresponding self terminating, shielded connectors, each shielded connector comprising, a conductive shell connected to at least one corresponding sheath, a dielectric support in the shell, a conductive switch contact connected to a corresponding signal transmitting conductor and carried by the dielectric support for disconnect connection to an electrical contact inserted into the shielded connector, and an electrical circuit element in contact with the shell constructed for disconnect coupling with the switch contact upon withdrawal of the electrical contact from the shielded connector, whereby the switch contact is terminated electrically to the shell through the circuit element.

An electrical connector for connection to an electrical cable having multiple signal carrying conductors encircled by dielectric material and by at least one conductive sheath comprises; a conductive shell connected to at least one corresponding sheath, a dielectric support in the shell, a conductive switch contact connected to at least one signal transmitting conductor and carried by the dielectric support for disconnect connection to an electrical contact inserted into the shielded connector, and an electrical circuit element in contact with the shell constructed for disconnect coupling with the switch contact upon withdrawal of the electrical contact from the shielded connector, whereby the switch contact is terminated electrically to the shell through the circuit element.

These and other advantages, features and objectives of the invention are disclosed by way of example from the following detailed description and accompanying drawings.

DESCRIPTION OF THE DRAWINGS

With reference to FIGS. 1 and 2, a cable assembly 1 includes an electrical cable 2 at one end connected to a single electrical connector 3, and at an opposite end connected to two electrical, shielded connectors 4 that can be joined together. The cable 2 comprises; multiple signal carrying conductors 5, each of which are of multiple strands encircled concentrically by dielectric material 6, in turn, encircled concentrically by a sheath 7 of conductive material over a flexible film of polyethylene terephthalate, in turn encircled concentrically by a conductive sheath 8 of braided wire strands, in turn, collectively encircled by an insulative jacket 9 oblate in transverse section. A conductive drain wire 10 extends along and in contact with the conductive sheaths 8

With reference to FIG. 5, the cable 2 is assembled to the connector 3 in a manner disclosed in U.S. Pat. No. 4,773,879. The connector 3 is a plug type and comprises, as shown generally at 11, an encircling a conductive shell 12, in turn, encircling a bipartite, insulative body 13, in turn, encircling an insulated electrical contact 14, and, for example, a coupling element 15 in the form of a bayonet type coupling ring rotatably mounted on the shell 12, and adapted for disconnect coupling to a coaxial jack, not shown.

Protruding portions of the signal carrying conductors 5 are twisted together and are connected to the contact 14. Protruding portions of the conductive sheaths 8 are outwardly spread, as in FIG. 4. Then the conductive sheaths 8 and a protruding portion of the drain wire 10 are placed to overlap a rear, sleeve section 16 of the shell 12, as in FIG. 5. A conductive sleeve 17 encircles the overlapped portions of the conductive sheaths 8 and the drain wire 10 and is radially deformed to clamp and connect the overlapped portions to the sleeve section 16 of the shell 12. Thereby, the cable 2 is connected electrically with the connector 3. With reference to FIG. 1, an insulative strain relief 18 is applied, for example, by injection molding a solidifiable insulative material, to encircle and adhere to the sleeve section 16 and corresponding portions of the cable 2 that are either connected with the connector 3 or adjacent to the connector 3. An insulative cylindrical cover 19 encircles the coupling ring 15 and is rotatable with the coupling ring 15.

With reference to FIGS. 1, two shielded electrical connectors 4 are connected to corresponding signal transmitting conductors 5 that protrude from the cable 2 shown in FIGS. 3 and 4. The shielded connectors 4 are operative as separate electrical connectors. For convenience they may be connected together in a manner to be described.

With reference to FIGS. 1, 3 and 4, each shielded connector 4 comprises, a conductive shell 20, a bipartite, dielectric support 21 for assembly in the shell 20, and for being encircled by a cylindrical portion 22 of the shell 20, a conductive switch contact 23 to be carried by the dielectric support 21, and an electrical circuit element 24, for example, a resistor, for mounting in the shell 20 and in contact with the shell 20, and constructed for disconnect coupling with the switch contact 23, whereby the switch contact 23 is terminated electrically to the shell 20 through the circuit element 24.

Figure 1:
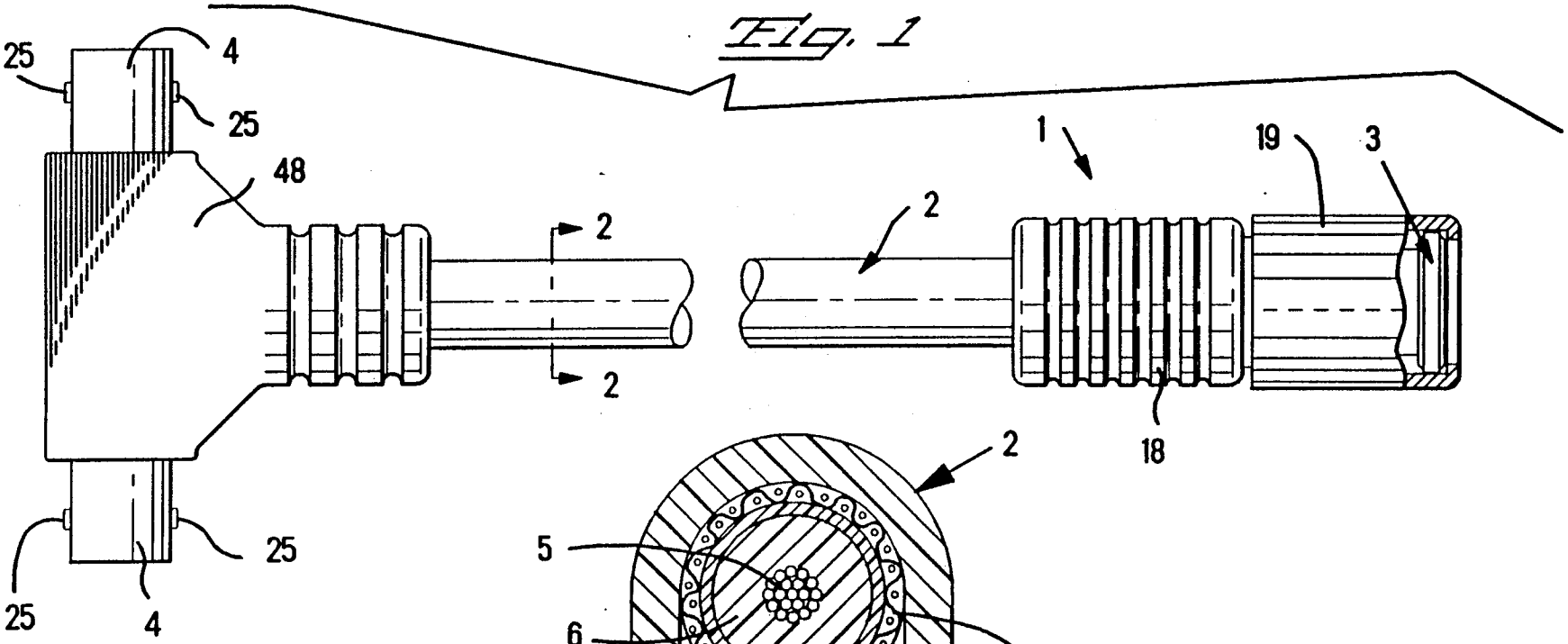
FIG. 1 is a fragmentary top plan view of a cable assembly.
Figure 2:
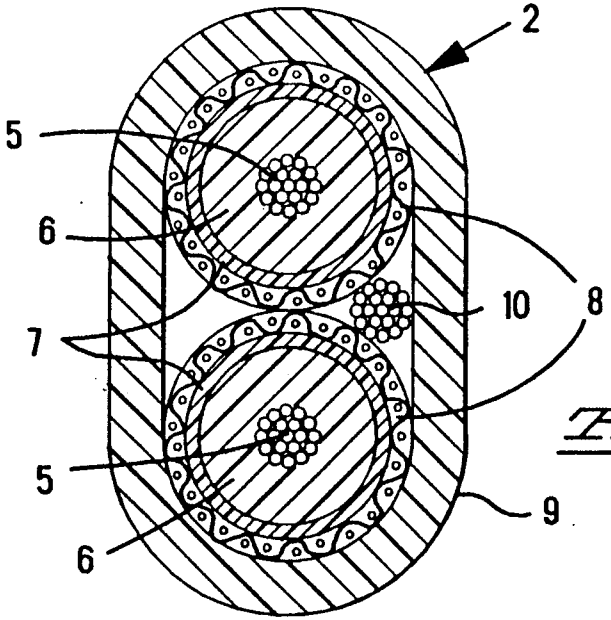
FIG. 2 is a section view taken along the line 2—2 of FIG. 1.

For example, each cylindrical portion 22 is provided with external bayonet coupling prongs 25. Each shell 20 has an open side 26 connecting along an open side 26 of another shell 20 in a manner as described in U.S. Pat. No. 4,687,446. Desirably, the shells 20 are in intimate contact without gaps to insure gap free shielding and continuous electrical paths along a shortest distance from one shell 20 to another. Semicylindrical portions 27 of corresponding shells 20 connect together to form a composite cylindrical portion 28. Each shielded connector 4 includes a bipartite dielectric support 29 constructed of duplicate sections 30 that separate to enable assembly with the switch contact 23 and the circuit element 24. The sections 30 face each other for assembly together in a corresponding shell 20.

Each switch contact 23 is of unitary construction, stamped and formed from a strip of metal, and comprises the following portions, a forward, sloped end 31, a curved contact 32, an elongated leaf spring 33, and an electrical terminal 34 that is curved to receive and become connected to a corresponding, protruding signal transmitting conductor 5. For example, the terminal 34 encircles and compressively is joined to the corresponding conductor 5. For example, the circuit element 24 is a cube of resistive material with opposite sides having corresponding conductive surfaces 35. The circuit element 24 is inserted in a recess 36 extending partially in each section 30 of the dielectric support 29. The recess 36 communicates with a corresponding shell 20. A corresponding conductive surface 35 of the circuit element 24 is against a corresponding shell 20.

A second switch contact 37 of straight, elongated construction is assembled along a corresponding passage 38 extending partially in each section 30. The passage 38 communicates with the recess 36 and with a contact receiving cavity 39 of each section 30. A corresponding end 40 of the second switch contact 37 is received in an undercut pocket 41 of each section 30 of the dielectric support 29 and is restrained from movement. The second switch contact 37 is deflected when mounted in a corresponding dielectric support 29, to bias the second switch contact 37 in pressure engagement against a corresponding conductive surface 35 of the circuit element 24. In turn, the circuit element 24 is biased to apply pressure engagement of the other conductive surface 35 against a corresponding shell 20.

For example, the circuit element 24 and the second switch contact 37 is assembled, first with one of the sections 30, followed by assembly of each switch contact 23 along a corresponding passage 42 extending in one of the sections 30. Each switch contact 23 has an elbow 43 along a corresponding shaped turn 44 of the passage 42 to restrain the switch contact 23 from movement. The leaf spring 33 of each switch contact 23 extends along a corresponding cavity 39 that communicates with a corresponding passage 42, and that is spacious to permit deflection of the leaf spring 33. Each cavity 39 communicates with a corresponding front end 45 of the dielectric support 29. The sloped front end 31 of each switch contact 23 projects across the corresponding cavity 39.

Each leaf spring 33 must be deflected to be mounted along a corresponding cavity 39 of a corresponding dielectric support 29. Each deflected leaf spring 33 biases the curved contact 32 in pressure engagement against a corresponding second switch contact 37. The pressure engagement establishes an electrical circuit that couples a corresponding signal transmitting conductor 5, the switch contact 23, the circuit element 24 and a corresponding shell 20. The circuit also extends along the second switch contact 37.

Figure 6:
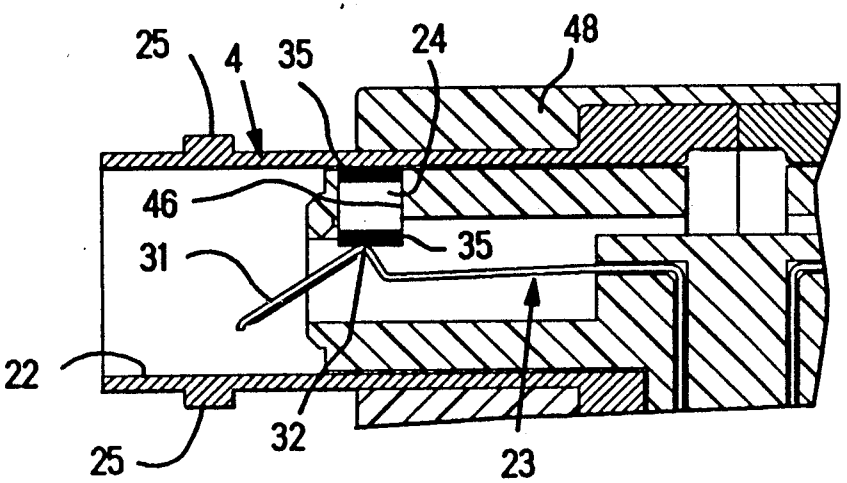
FIG. 6 is a fragmentary view in section of a selected construction of a portion of the cable assembly of FIG. 1.

With reference to FIG. 6, each dielectric support 29 is alternatively provided with a recess 46 extending partially in each of the sections 30 and receiving a corresponding circuit element 24 in alignment with a corresponding curved contact 32. Each leaf spring 33 must be deflected to be mounted along a corresponding cavity 39 of a corresponding dielectric support 29. Each deflected leaf spring 33 biases the curved contact 32 in pressure engagement against a conductive surface 35 of a corresponding circuit element 24. The pressure engagement establishes an electrical circuit that couples a corresponding signal transmitting conductor 5, the switch contact 23, the circuit element 24 and a corresponding shell 20.

Figure 3:
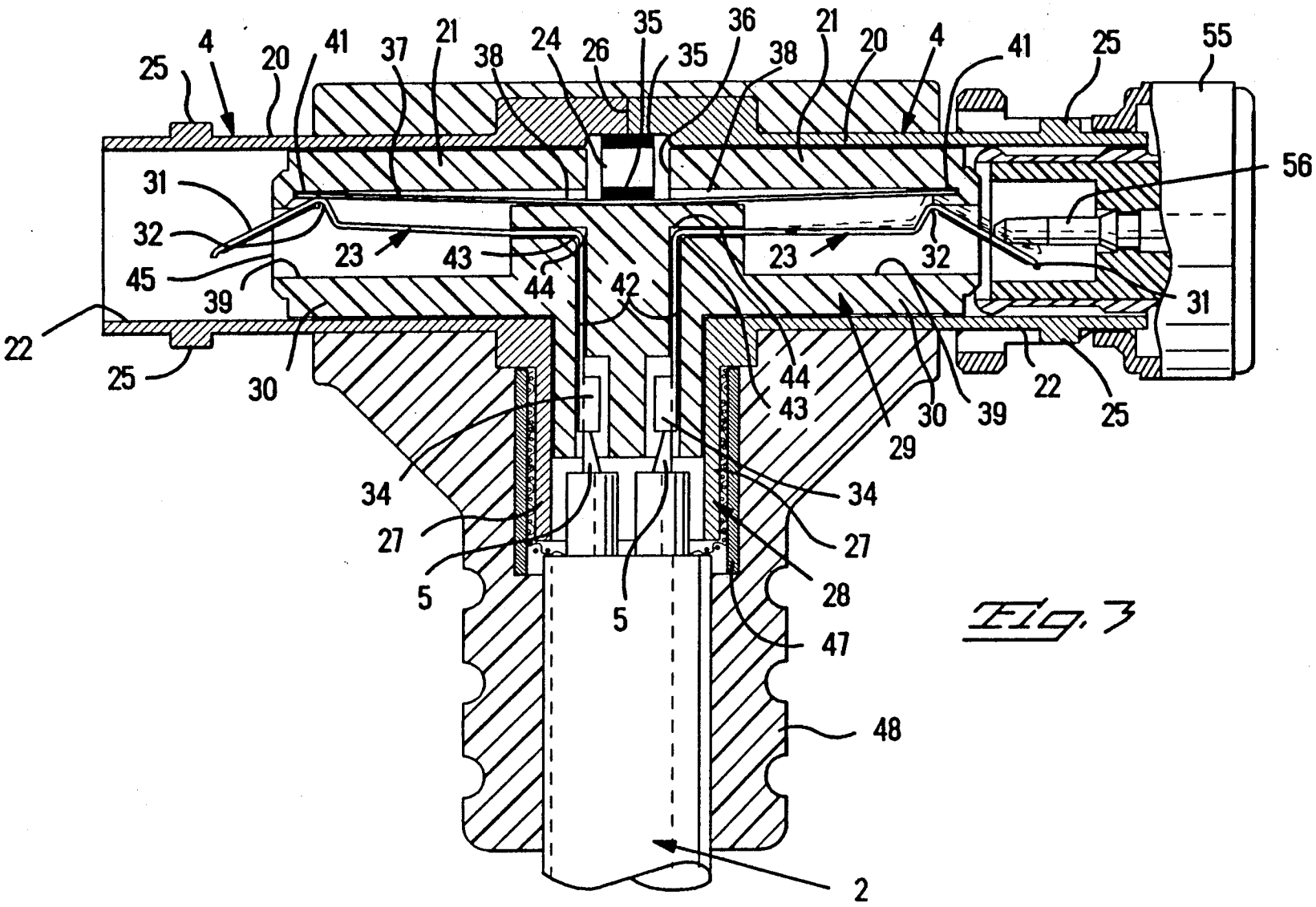
FIG. 3 is a fragmentary enlarged plan view in section of a portion of the cable assembly shown in FIG. 1.
Figure 4:
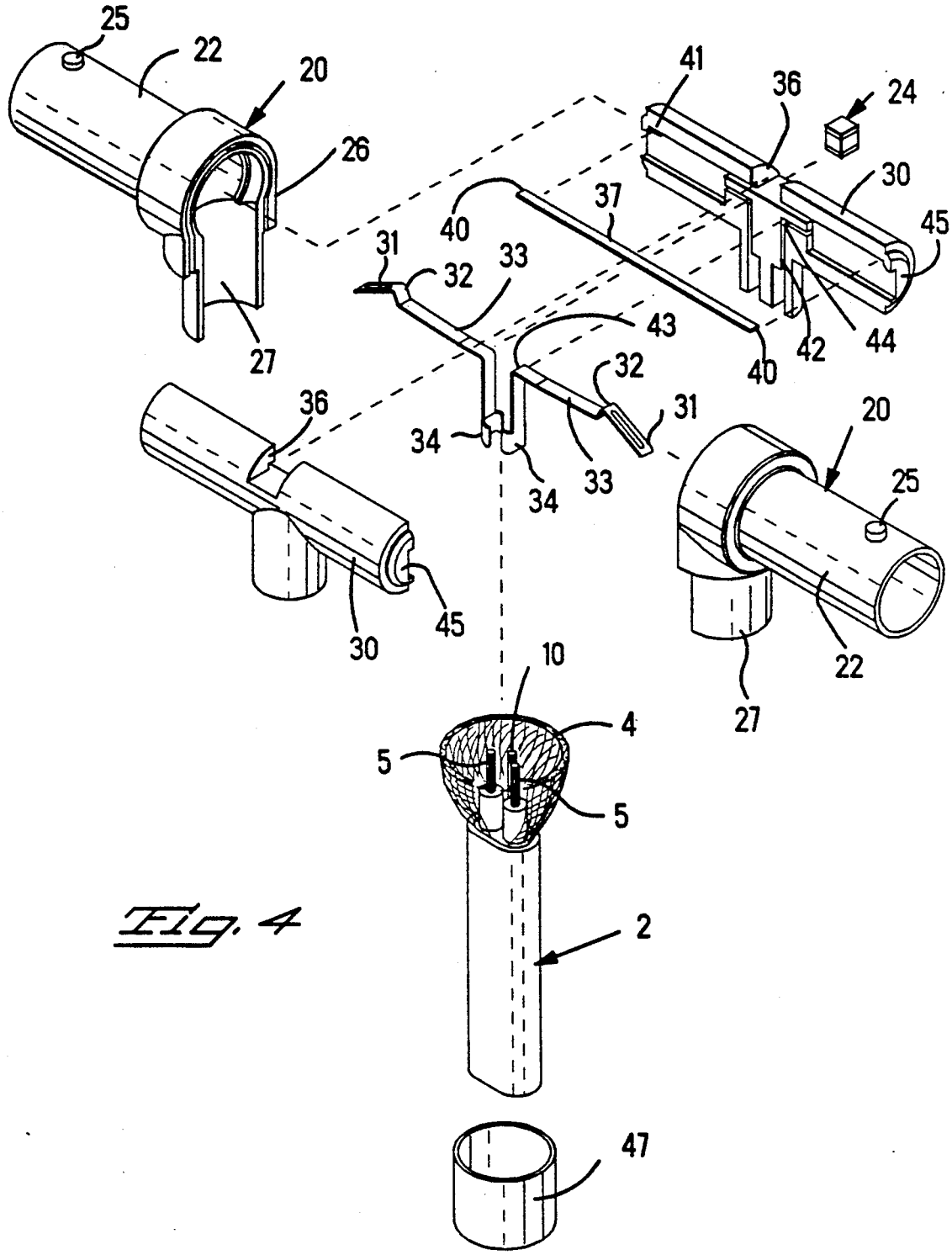
FIG. 4 is a fragmentary perspective view with parts exploded of a portion of the cable assembly as shown in FIG. 3.
Figure 5:
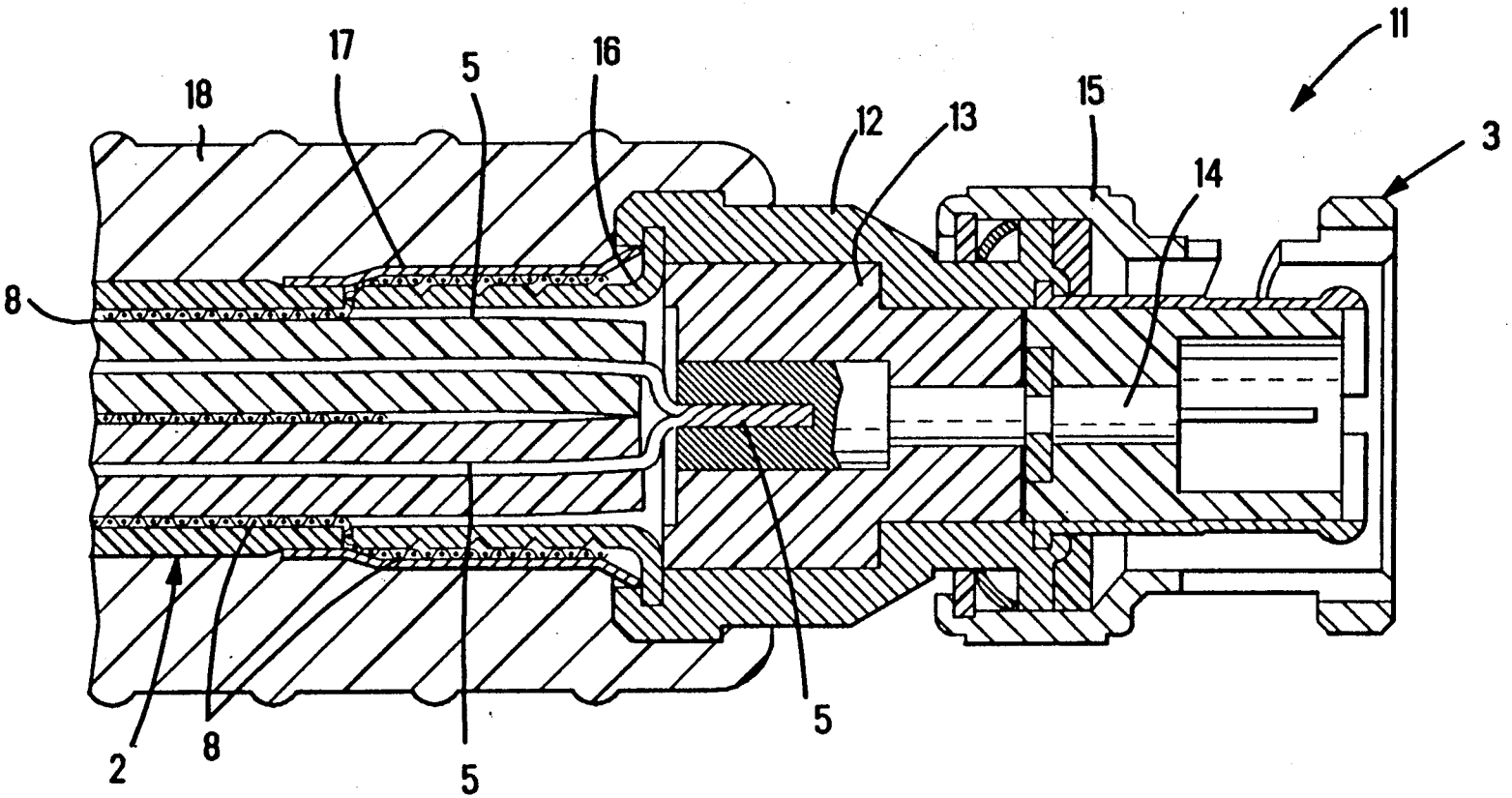
FIG. 5 is a fragmentary view in section of a portion of the cable assembly shown in FIG. 1.

With reference to FIGS. 3 and 4, the shells 20 are brought together along their open sides 26. Protruding portions of the conductive sheaths 8 are outwardly spread, as in FIG. 4. Then the conductive sheaths 8 and a protruding portion of the drain wire 10 are placed to overlap the composite cylindrical portion 28, as in FIG. 3. A conductive sleeve 47 encircles the overlapped portions of the conductive sheaths 8 and the drain wire 10 and is radially deformed to clamp and connect the overlapped portions to the corresponding shells 20. Thereby, the cable 2 is connected electrically with each shielded connector 4. The corresponding shells 20 provide shields encircling corresponding insulated switch contacts 23. With reference to FIG. 3, an insulative strain relief 48 is applied, for example, by injection molding a solidifiable insulative material, to encircle and adhere to the corresponding connectors 4, the composite cylindrical portion 28, the conductive sleeve 47 and the corresponding portions of the cable 2, either connected with the corresponding connectors 4 or adjacent to the corresponding connectors 4.

Figure 7:
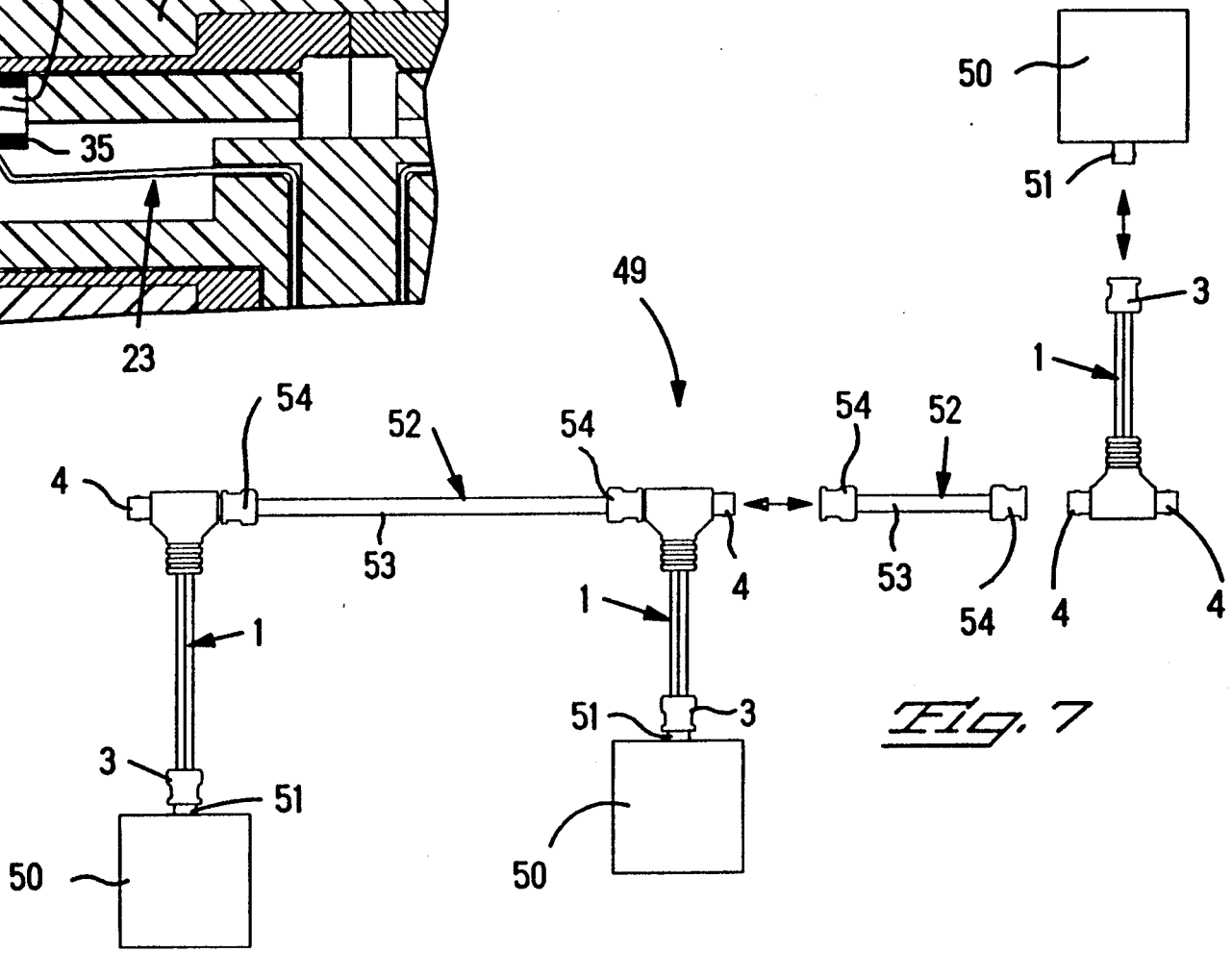
FIG. 7 is a schematic view of a local area network.

With reference to FIG. 7, the cable assembly 1 is useful to build a local area network 49 that interconnects computer work stations, each shown at 50, and that self terminates to prevent disruption of the network 49 when a work station 50 is disconnected from the network 49. Each work station 50 incorporates its own transceiver, not shown, that functions as described above. Each work station 50 has a coaxial jack type connector 51. Each work station 50 to be connected along the network 49 is provided with a corresponding cable assembly 1, by coupling the coaxial connector 3 of the cable assembly 1 to the connector 51 of the work station 50.

A network 49 of two work stations 50 is built by linking two cable assemblies 1 of the work stations 50 with a standard cable assembly 52. The standard cable assembly 52 is constructed of a known coaxial cable 53 having a single, signal transmitting conductor, like one of the conductors 5, connected at opposite ends with plug type coaxial connectors 54 of known construction. FIG. 7 shows a standard cable assembly 52 connected to two cable assemblies 1 associated with corresponding work stations 50. Communications signals can be transmitted between the two work stations 50 along a network 49 built by the two cable assemblies 1 and the standard cable assembly 52.

FIG. 3 shows disconnect coupling of the standard cable assembly 52 with the shielded connector 4 of the cable assembly 1. A bayonet coupling ring 55 of the connector 54 is connected to the bayonet prongs 25 of the shielded connector 4. A signal transmitting center contact 56 of the connector engages the switch contact 23 of the shielded connector 4, thereby establishing a signal transmitting circuit that couples the work station 50, a corresponding signal transmitting conductor 5, the switch contact 23, the standard cable assembly 52, and the corresponding cable assembly 1 associated with the second work station 50.

With reference to FIG. 3, The center contact 56 deflects the switch contact 23 away from the second switch contact 37 to disengage the switch contact 23, and to disconnect the electrical circuit coupling the circuit element 24 with the switch contact 23. When the connector 54 of the standard cable assembly 52 is disconnected from the shielded connector 4, the second switch contact 37 will return by spring action to engage the second switch contact 37, thereby again establishing the circuit that couples a corresponding signal transmitting conductor 5, the switch contact 23, the circuit element 24 and a corresponding shell 20. The circuit also extends along the second switch contact 37.

With reference to FIG. 6, deflection of the switch contact 23 away from the circuit element 24, for example, by a center contact 56, not shown, will interrupt the circuit that couples the circuit element 24 and the switch contact 23. In the absence of a center contact 56, the second switch contact 37 will return by spring action to engage the circuit element 24.

With reference to FIG. 3, the shielded connector 4 of the cable assembly 1 that is not connected with a standard cable assembly 52 is self terminating, in that the switch contact 23 is coupled to the shell 20 through a fixed impedance provided by the impedance of the circuit element 24. The above described network 49 of the two work stations 50 is not disrupted, since the self terminating, shielded connector 4 will not appear as an open circuit to transmission of a communications signal from either of the two work stations 50.

With reference to FIG. 7, an advantage of the cable assembly 1 is that a network 49 built with the cable assembly 1 can be extended by adding a combination comprising, another work station 50 and another cable assembly 1 and another standard cable assembly 52. According to another advantage, the network 49 can be reduced by disconnecting the combination, without disrupting the network 49, since each shielded connector 4 of the cable assembly 1 is self terminating in the absence of being connected to a standard cable assembly 52. Another advantage is that a work station 50 may be removed from the network 49 to be available as a portable work station 50 away from the network 49, and can return to the network 49, without disrupting the network 49.

Each of the discussed advantages, features and objectives of the disclosed invention exists independently and contributes to the use and importance of the invention.

We claim:

1. A connector assembly comprising;

at least first and second connectors each having conductive shells, said first and said second connectors having respective coupling portions for disconnectable connection to respective connectors for respective two electrical cables, conductive signal contacts extending in said first and said second connectors and extending into third connector means joined to said first and said second connectors, insulative material insulating the conductive contacts from one another and also from shells of said first and said second connectors, and an electrical circuit connected to the shells of at least said first and said second connectors, at least one circuit element having an impedance in the electrical circuit being disconnectable from a first of said conductive contacts when a corresponding said respective connector is disconnectably coupled to said first connector to interrupt the electrical circuit, and being disconnectable from a second of said conductive contacts when a corresponding said respective connector is disconnectably coupled to said second connector to interrupt the electrical circuit.

2. A connector assembly as recited in claim 1, comprising;

said third connector means being connected to a cable having two conductive shields encircling insulation material, in turn, encircling respective two signal conductors, and said conductive contacts being connected to respective said signal conductors, said cable being constructed for connection to a computer work station.

3. A connector assembly as recited in claim 1, comprising;

each said circuit element includes a resistive material between conductive surface contacts, one of the surface contacts being engaged against the shells.

4. A connector assembly as recited in claim 1, comprising;

each of said conductive contacts being deflectable independently of each other to interrupt the electrical circuit connecting the corresponding conductive contact and said at least one circuit element.

5. A connector assembly as recited in claim 1, comprising;

a switch contact in the electrical circuit and in the first and second connectors disconnectably engaging the first and second contacts, and being disengageable from the first contact upon interruption of the electrical circuit, and being disengageable from the second contact upon interruption of the electrical circuit.

6. An electrical connector assembly for connection to multiple respective connectors comprising:

a first connector having a conductive shell, a second connector having a conductive shell, a third connector having a conductive shell connected directly to the shell of the first connector and the shell of the second connector, a conductive first contact in the first connector extending in the third connector and connected to a corresponding signal transmitting second conductor extending into said third connector, a conductive second contact in the second connector extending in the third connector and connected to a corresponding signal transmitting second conductor extending into said third connector, an electrical circuit containing at least one circuit element having an impedance, said electrical circuit coupling said first conductor and said first contact and said first shell, and being interrupted to disconnect said first contact from said at least one circuit element by coupling said first connector to a corresponding respective connector, said electrical circuit coupling said second conductor and said second contact and said second shell, and said being interrupted to disconnect said second contact from said at least one circuit element by coupling said second connector to a corresponding respective connector.

7. A connector assembly as recited in claim 6, comprising;

said third connector being connected to a cable having two conductive shields encircling insulation material, in turn, encircling said corresponding signal transmitting conductors.

8. A connector assembly as recited in claim 6, comprising;

each said circuit element includes a resistive material between conductive surface contacts, one of the surface contacts being engaged against the corresponding shell of each said first and said second connector.

9. A connector assembly as recited in claim 6, comprising;

each of said conductive contacts being deflectable independently of each other to interrupt the electrical circuit connecting the corresponding conductive contact and said at least one circuit element.

10. A connector assembly as recited in claim 6, comprising;

a switch contact in the electrical circuit and in the first and second connectors disconnectably engaging the first and second contacts, and being disengageable from the first contact upon interruption of the electrical circuit, and being disengageable from the second contact upon interruption of the electrical circuit.

11. An electrical connector assembly, useful in a network for connecting means incorporating transceivers for computer work stations and corresponding cable assemblies, comprising:

a first connector having a conductive shell and constructed for disconnectable connection to a corresponding connector of a corresponding said cable assembly, a second connector having a conductive shell connected directly to the first connector, and constructed for disconnectable connection to a corresponding connector of a corresponding said cable assembly, connecting means for connecting said first connector and said second connector to means for incorporating a transceiver for a computer work station, a conductive first contact in the first connector constructed for disconnectable connection to a corresponding connector of a corresponding said cable assembly, a conductive second contact in the second connector constructed for disconnectable connection to a corresponding connector of a corresponding said cable assembly, a circuit including, at least one circuit element having an impedance, said first contact and said first shell, and said second contact and said second shell, each said first contact and said second contact being disconnectable independently of the other from said at least one circuit element by said connection of a respective one of said first and second connectors to a corresponding said connector of a corresponding said cable assembly, and each said first contact and said second contact being connectable independently of each other with said at least one circuit element by disconnection of a respective one of said first and second connectors from a corresponding connector of a corresponding said cable assembly, whereby said first connector and said second connector are self terminating independently of each other upon said disconnection.

12. An electrical connector assembly as recited in claim 11, comprising;

a first switch contact in said circuit engaging said first contact when said first contact is disconnected from a corresponding connector of a corresponding said cable assembly, and a second switch contact in said circuit engaging said second contact when said second contact is disconnected from a corresponding connector of a corresponding said cable assembly.

13. An electrical connector assembly as recited in claim 12, comprising; said first contact is deflectable toward and away from said first switch contact, and said second contact is deflectable toward and away from said second switch contact.

14. An electrical connector assembly as recited in claim 12, comprising; said at least one circuit element engages said switch contacts and a corresponding shell of said first and said second contacts.

15. A connector assembly as recited in claim 11, comprising; said shells are connected together as a composite shell.

16. A connector assembly as recited in claim 11, comprising; said first and said second switch contacts are connected together and are connected to said at least one circuit element.

17. A connector assembly comprising;

at least first and second connectors each having conductive shells forming a composite shell, said first and said second connectors having respective coupling portions for disconnectable connection to respective connectors for respective two electrical cables, conductive signal contacts extending in said first and said second connectors and extending into third connecting means joined to said first and said second connectors for connecting said first and said second connectors to means for incorporating a transceiver of a computer work station, insulative material insulating the conductive contacts from one another and also from the shells of said first and said second connectors, and an electrical circuit connected to the shells of said first and said second connectors, at least one circuit element having an impedance in the electrical circuit being disconnectable from a first of said conductive contacts when a corresponding said respective connector is disconnectably coupled to said first connector to interrupt the electrical circuit, and being disconnectable from a second of said conductive contacts when a corresponding said respective connector is disconnectably coupled to said second connector to interrupt the electrical circuit.

18. An electrical connector with two shielded electrical connectors for connection to respective connectors of corresponding cable assemblies, comprising:

a conductive shell for said two shielded connectors, an insulative support within the shell, at least one switch contact in the shell supported by the insulative support, at least one circuit element having an impedance connected to said shell and to said at least one switch contact, each of the shielded electrical connectors having an electrical contact disconnectably coupled with said at least one switch contact and extending within the shell for connection to one of the respective connectors, each electrical contact is disconnected independently of the other from said at least one switch contact upon connection of said electrical contact with one of the respective connectors, connecting means connected to the shielded electrical connectors for connecting the shielded electrical connectors to means for incorporating a transceiver of a computer work station, and each of the shielded electrical connectors having a corresponding said electrical contact extending along said connecting means.

* * * * *